US006926573B2

(12) United States Patent
Moon

(10) Patent No.: US 6,926,573 B2
(45) Date of Patent: Aug. 9, 2005

(54) AGING APPARATUS OF FIELD EMISSION DISPLAY AND METHOD THEREOF

(75) Inventor: Seong Hak Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/693,908

(22) Filed: Oct. 28, 2003

(65) Prior Publication Data

US 2004/0085306 A1 May 6, 2004

(30) Foreign Application Priority Data

Oct. 29, 2002 (KR) ..... 10-2002-0066253
May 23, 2003 (KR) ..... 10-2003-0033058

(51) Int. Cl.[7] ..... H01J 9/00
(52) U.S. Cl. ..... 445/24; 345/204
(58) Field of Search ..... 445/24, 59, 40, 445/5, 38; 345/60, 84, 87, 97, 204

(56) References Cited

U.S. PATENT DOCUMENTS 6,409,564 B1 * 6/2002 Browning et al. ..... 445/24
6,500,040 B2 * 12/2002 Browning et al. ..... 445/24

* cited by examiner

*Primary Examiner*—Wilson Lee
(74) *Attorney, Agent, or Firm*—Fleshner & Kim, LLP

(57) ABSTRACT

In an aging apparatus of a FED (field emission display) and a method thereof capable of reducing damage occurrable in applying of a direct current high voltage to an anode electrode of a FED to perform aging, increasing life span of the FED and reducing a time required for aging, the method includes converting a direct current high voltage into a first high voltage pulse having uniform frequency and duty cycle or a second high voltage pulse having a frequency and a duty cycle varied according to time; and applying the converted first high voltage pulse or the second high voltage pulse to an anode electrode of a panel.

18 Claims, 8 Drawing Sheets

AGING APPARATUS OF FIELD EMISSION DISPLAY AND METHOD THEREOF

BACKGROUND OF THE INVENTION

1. Field of the Invention

The present invention relates to a FED (field emission display), and in particular to an aging apparatus of the FED and a method thereof.

2. Description of the Related Art

Recently, mobile radio communication such as an IMT-2000 has been spotlighted. The mobile radio communication requires a high quality, a quick speed, a low weight and low power consumption. A MIM (metal insulator metal) is a switching device capable of satisfying the requisites.

In general, the FED has a high vacuum region between an upper plate and a lower plate in which high voltage is applied. Between the upper plate and the lower plate, namely, a high vacuum region is formed between an anode and a cathode in order to emit electrons.

However, in fabrication of a vacuum tube for forming a high vacuum region, contamination may exist on the surface of the tube or an electrode.

If contamination exists in the high vacuum region, when the FED is displayed, electrons having sufficient energy are emitted, the electrons crash against the contamination, and particles of the contamination are separated from the surface of the high vacuum region. When that phenomenon occurs, because a high ionization pressure region is formed in the vacuum, electron emission between a scan electrode and a gate electrode is accelerated, the emitted electrons are not emitted to the anode but overheat a gate electrode.

Afterward, when the gate electrode is overheated, luminance discharge current over an energy gap between a scan electrode and a gate electrode is formed, it may damage the scan electrode severely, and accordingly life span of the FED may be lowered. That phenomenon is called arcing.

In order to prevent occurrence of arcing, there has to be no contamination in the high vacuum region. Accordingly, in the conventional method for eliminating contamination of the MIM FED, substance (getter) for adsorbing contamination is put into the FED to adsorb contamination in operating of the FED.

However, in order to put the substance into the vacuum region between the upper plate and the lower plate, an additional process is required. In addition, the adsorbing substance has a capacity limitation, in particular, capacity of the adsorbing substance is varied according to a size of the MIM FED, because it can not adsorb the contamination over a certain limitation point, still there is a possibility of arcing occurrence. In order to solve the problem, there is a method for eliminating contamination by performing aging.

The conventional aging method for eliminating contamination by using a direct current high voltage will be described.

First, when a direct current high voltage to be gradually increased up to a maximum voltage is applied to an anode, contamination is taken away from the surface of the FED to a vacuum region. Herein, the vacuum state of the FED is maintained not by sealing but by a vacuum pump, and accordingly the contamination is discharged to the outside by the vacuum pump.

Afterward, by applying a voltage to the data electrode and the scan electrode of the FED, electrons are emitted, contamination is taken away again by the emitted electrons, and the contamination is discharged to the outside by the vacuum pump.

However, in the conventional aging method, by applying a direct current high voltage to the FED, lots of energy is consumed. In addition, in the conventional aging method, the FED may be damaged by the inputted lots of energy, and accordingly life span of the FED may be lowered.

SUMMARY OF THE INVENTION

In order to solve the above-mentioned problem, it is an object of the present invention to provide an aging apparatus of a FED (field emission display) and a method thereof capable of reducing damage occurrable by a direct current high voltage, increasing life span of a FED and improving quality of a product by applying a first high voltage pulse having uniform frequency and duty cycle or a second high voltage pulse having variable frequency and duty cycle to an anode electrode of the FED.

It is another object of the present invention to provide an aging apparatus of a FED and a method thereof capable of reducing a time required for aging by applying a high voltage pulse to an anode electrode of a panel.

It is yet another object of the present invention to provide an aging apparatus of a FED and a method thereof capable of eliminating arching through aging in a short time and reducing energy consumption by converting a high voltage pulse into a high voltage pulse of low energy and applying it to an anode electrode.

In order to achieve the above-mentioned objects, an aging method of a FED in accordance with the present invention includes converting a direct current high voltage into a first high voltage pulse having uniform frequency and duty cycle or a second high voltage pulse having a frequency and a duty cycle varied according to time; and applying the converted first high voltage pulse or second high voltage pulse to an anode electrode of a panel.

In order to achieve the above-mentioned objects, an aging apparatus of a FED in accordance with the present invention includes an aging controlling unit for converting a direct current high voltage into a first high voltage pulse having uniform frequency and duty cycle or a second high voltage pulse having a frequency and a duty cycle varied according to time and applying the converted first high voltage pulse or second high voltage pulse to an anode electrode of a panel.

In order to achieve the above-mentioned objects, an aging method of a FED in accordance with the present invention includes converting a direct current high voltage into a first high voltage pulse having uniform frequency and duty cycle and applying the converted first high voltage pulse to an anode electrode of a panel for a preset pre-aging time; and converting a direct current high voltage into a second high voltage pulse having variable frequency and duty cycle and applying the converted second high voltage pulse to the anode electrode of the panel for a preset main aging time; wherein a predetermined voltage is applied to a scan driving unit of the FED when the second high voltage pulse is applied to the anode electrode.

In order to achieve the above-mentioned objects, an aging apparatus of a FED in accordance with the present invention includes a means for converting a direct current high voltage into a first high voltage pulse having uniform frequency and duty cycle and applying the converted first high voltage pulse to an anode electrode of a panel for a preset pre-aging time; a means for converting the direct high voltage into a second high voltage pulse having variable frequency and duty cycle and applying the converted second high voltage pulse to the anode electrode of the panel for a preset main aging time; and a means for applying a predetermined voltage to a scan driving unit of the FED in applying of the second high voltage pulse to the anode electrode.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, an aging apparatus of a FED (field emission display) and a method thereof capable of reducing damage occurrable by a direct current high voltage, increasing a life span of a FED, improving a product's quality and reducing a time required for aging by applying a first high voltage pulse having uniform frequency and duty cycle and a second high voltage pulse having variale frequency and duty cycle to an anode electrode of the FED.

First, terms used in the present invention will be defined. First, an operation for eliminating dangerous factors occurrable in aging by using only an anode voltage (Va) is called pre-aging, and a process for reducing occurrence probability of arching in current aging by emitting electrons after the anode voltage (Va) is supplied is called main aging.

Figure 1:
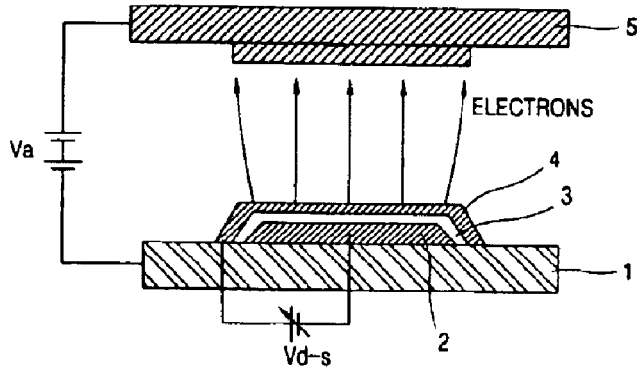
FIG. 1 is a schematic sectional-view illustrating aging of a FED (field emission display) in accordance with the present invention.

FIG. 1 is a schematic sectional-view illustrating aging of a FED (field emission display) in accordance with the present invention.

As depicted in FIG. 1, the FED includes a scan electrode 2 laminated on the top of a lower plate 1; an insulating layer 3; a data electrode 4; and an anode electrode 5 formed so as to face the data electrode 4 with a certain gap. The gap between the data electrode 4 and the anode electrode 5 is highly vacuumed, the high vacuum state is not by a sealing process but by a vacuum pump. The operation of the FED will be described briefly.

First, when a certain voltage (Vd-s) is applied to the data electrode 4 and the scan electrode 2, electrons are emitted from the scan electrode 2, and the electrons are emitted through the insulating layer 3 and the data electrode 4 by a quantum-dynamic tunnel effect.

The emitted electrons are accelerated toward the anode electrode 5 on which a fluorescent material is coated by the high anode voltage (Va), when the electrons crash against the fluorescent material, energy is generated, the electrons on the fluorescent material are excited by the energy, and light is emitted. Hereinafter, a construction of the aging apparatus of the FED in accordance with the first embodiment of the present invention will be described in detail with reference to FIG. 2.

First Embodiment

Figure 2:
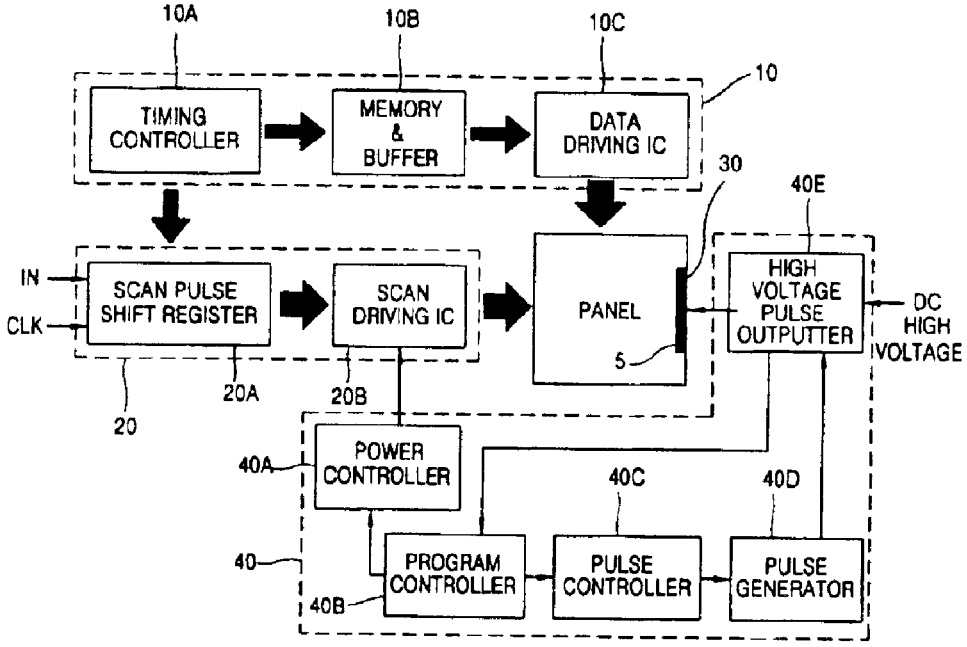
FIG. 2 is a block diagram illustrating a construction of an aging apparatus of a FED in accordance with a first embodiment of the present invention.

FIG. 2 is a block diagram illustrating a construction of an aging apparatus of a FED in accordance with a first embodiment of the present invention.

As depicted in FIG. 2, the aging apparatus of the FED includes a data driving unit 10 for outputting a timing control signal and a data pulse; a scan driving unit 20 for outputting a scan pulse by receiving data (IN) inputted from the outside and a clock signal (CLK) according to the timing control signal outputted from the data driving unit 10; a panel 30 for displaying the data (IN) by receiving the data pulse outputted from the data driving unit 10 and the scan pulse outputted from the scan driving unit 20; and an aging controlling unit 40 for applying a high voltage pulse to the anode electrode 5 of the panel 30 and applying a predetermined voltage to the scan driving unit 20.

The data driving unit 10 consists of a timing controller 10A; a memory and buffer 10B; and a data driving IC 10C. The scan driving unit 20 consists of a scan pulse shift register 20A; and a scan driving IC 20B.

In addition, the aging controlling unit 40 includes a power controller 40A for applying a predetermined voltage to the scan driving unit 20 according to a power control signal from the outside; a pulse controller 40C for receiving the program control signal from the outside and outputting a pulse control signal corresponded to fixed (uniform) and duty cycle or frequency and duty cycle varied according to time; a pulse generator 40D for receiving the pulse control signal outputted from the pulse controller 40C and outputting a pulse signal corresponded to the pulse control signal; a high voltage pulse outputter 40E for receiving the pulse signal outputted from the pulse generator 40D, converting a direct current high voltage into a pulse type high voltage and applying it to the anode electrode 5; and a program controller 40B for detecting a current applied to the anode electrode 5 from the high voltage pulse outputter 40E, comparing the detected current value with a preset limit current value and outputting a program control signal and a power control signal respectively to the pulse controller 40C and the power controller 40A. Herein, a construction of the pulse controller will be described in detail with reference to accompanying FIG. 3.

Figure 3:
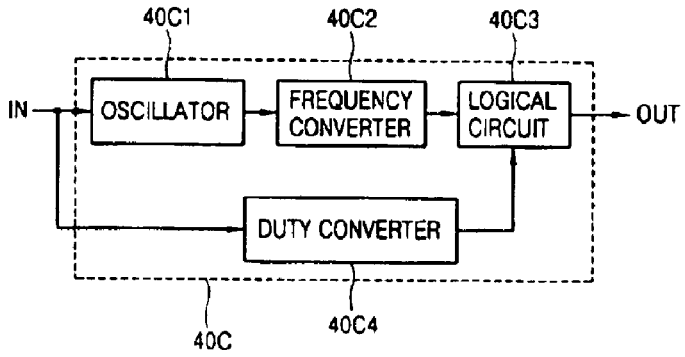
FIG. 3 is a block diagram illustrating a construction of a pulse controller in FIG. 2.

FIG. 3 is a block diagram illustrating the construction of the pulse controller.

As depicted in FIG. 3, the pulse controller 40C consists of an oscillator 40C1 for receiving a program control signal (in) outputted from the program controller 40B and outputting a frequency; a frequency converter 40C2 for converting the frequency outputted from the oscillator 40C1 and outputting it; a duty converter 40C4 for receiving the program control signal (in) outputted from the program controller 40B and outputting a duty cycle corresponded to the program control signal (in); and a logical circuit 40C3 for receiving the frequency outputted form the frequency converter 40C2 and the duty cycle outputted from the duty converter 40C4 and outputting a pulse control signal (out) to the pulse generator 40D.

In addition, the high voltage pulse outputter 40E consists of a switching means (not shown) turned on/off by the pulse signal outputted from the pulse generator 40D in order to switch the inputted direct current high voltage and output it.

In addition, the program controller 40B detects a current applied from the high voltage outputter 40E to the anode electrode 5, when the detected current is greater than the preset limit current value, it outputs a program control signal for turning off the switching means to the pulse controller 40C or stops a program in order not to apply the high voltage to the anode electrode 5.

The power controller 40A is sued in main aging only with the scan driving voltage.

The program controller 40B and the power controller 40A, the program controller 40B and the pulse controller 40C, the program controller 40B and the high voltage pulse outputter 40E are mutually connected with a general interface bus.

Hereinafter, in the operation of the aging apparatus of the FED, a pre-aging operation and a main aging operation will be described sequentially with reference to FIG. 4. In addition, all operations of the present invention are performed according to the program.

Pre-aging Operation

First, when a direct current high voltage gradually increased is inputted to the switching means of the high voltage pulse outputter 40D, the program controller 40B outputs a program control signal to the pulse controller 40C.

The pulse controller 40C receives the program control signal outputted from the program controller 40B and outputs a pulse control signal having a frequency and a duty cycle. In more detail, the oscillator 40C1 receives the program control signal and outputs a frequency corresponded to the program control signal to the frequency converter 40C2. The frequency converter 40C2 converts the frequency into a request frequency and outputs it to the logical circuit 40C3. The duty converter 40C4 receives the program control signal and outputs a duty cycle corresponded it to the logical circuit 40C3. The logical circuit 40C3 receives the frequency from the frequency converter 40C2 and the duty cycle from the duty converter 40C4 and outputs a pulse control signal (out) to the pulse generator 40D.

Afterward, the pulse generator 40D receives the pulse control signal from the pulse controller 40C and outputs a pulse signal corresponded to it (a pulse signal having uniform frequency and duty cycle) in order to turn on/off the switching means of the high voltage pulse outputter 40E. As depicted in FIG. 4, by the on/off of the switching means 40E, the high voltage pulse having the uniform frequency and duty cycle is applied to the anode electrode 5 of the panel 30. The high voltage pulse having the uniform frequency and duty cycle is applied to the anode electrode 5 continually while performing pre-aging.

In addition, when the high pulse voltage is applied to the anode electrode 5, the program controller 40B detects a current outputted to the anode electrode 5 from the high voltage pulse outputter 40E, compares the detected current value with the present limit current value and applies a high voltage pulse.

For example, when the detected current value is greater than the limit current value, in order to reduce damage of the FED, the high voltage pulse applied to the anode electrode 5 is cut off. As an example of a method for cutting off the high voltage pulse, when the pulse controller 40C outputs a pulse control signal having a duty cycle as '0', the pulse signal outputted from the pulse generator 40D is off, and accordingly the switching means is off. In more detail, the high voltage is not applied to the anode electrode 5. The high voltage pulse applied to the anode electrode will be described with reference to FIG. 4.

Figure 4:
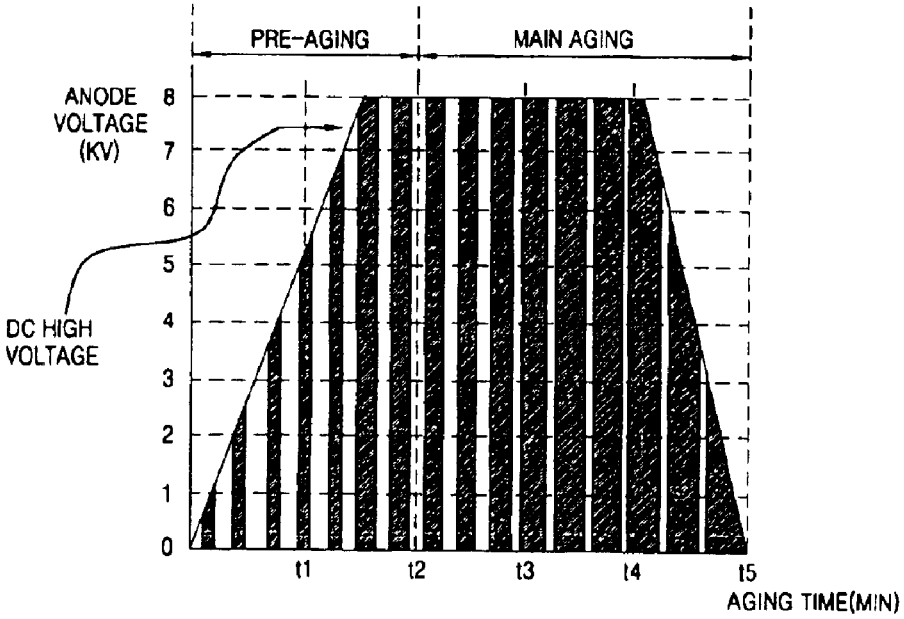
FIG. 4 illustrates a high voltage pulse applied to an anode electrode in accordance with the first embodiment of the present invention.

FIG. 4 illustrates a high voltage pulse applied to an anode electrode in accordance with the first embodiment of the present invention.

As depicted in FIG. 4, the limit current value about the inputted direct current high voltage and values about slant and time can be stored in an internal memory of the program controller 40B or the high voltage pulse outputter 40E. For example, when the inputted direct current high voltage is 0~5KV, time is 0~t1, slant is 3 and limit current value is 100 mA, data about the direct current high voltage is pre-stored in the memory as a table form.

In addition, when a current value detected from the program controller 40B is less than the limit current value, the switching means of the high votlage pulse outputter 40E is on/off by the pulse signal outputted from the pulse generator 40D, and accordingly an increased high voltage pulse is applied to the anode electrode 5 again.

Afterward, by turning on/off the switching means, high voltage up to a preset maximum value is applied. In more detail, as depicted in FIG. 4, a maximum voltage (8KV) is applied, and the maximum voltage is maintained continually for the present pre-aging time. That operation is performed in a unsealed state, contamination generated in the pre-aging operation is discharged by a vacuum pump.

Main Aging Operation

When the pre-aging operation is finished, the program controller 40B outputs a program control signal for applying a high voltage pulse having a frequency and a duty cycle varied according to time to the pulse controller 40C.

The pulse controller 40C receives the program control signal and outputs a pulse control signal having a frequency and a duty cycle varied according to time.

Afterward, the pulse generator 40D receives the pulse control signal and outputs a pulse signal, by the pulse signal, the switching means of the high voltage pulse outputter 40E is on/off, as depicted in FIG. 4, the high voltage pulse having a frequency and a duty cycle gradually increased for a main aging time is applied to the anode electrode 5 for a t3~t5 time.

In addition, when the pre-aging operation is finished, the program controller 40B outputs the power control signal to the power controller 40A. The power controller 40A receives the power control signal from the program controller 40B and applies power to the scan driving unit 20. In more detail, by applying power to the scan driving unit 20, aging operation by the current is performed for the certain time t2~t5. In more detail, by emitting electrons from the scan electrode 2 of the FED, current aging is performed.

Contamination separated through the main aging is discharged to the outside by the vacuum pump.

When the pre-aging and main aging operations are finished, a vacuum region in a high vacuum state is sealed. Accordingly, in the present invention, it is possible to eliminate contamination without using a contamination getter.

Hereinafter, an aging method of a FED in accordance with a first embodiment of the present invention will be described with reference to FIG. 5.

Figure 5:
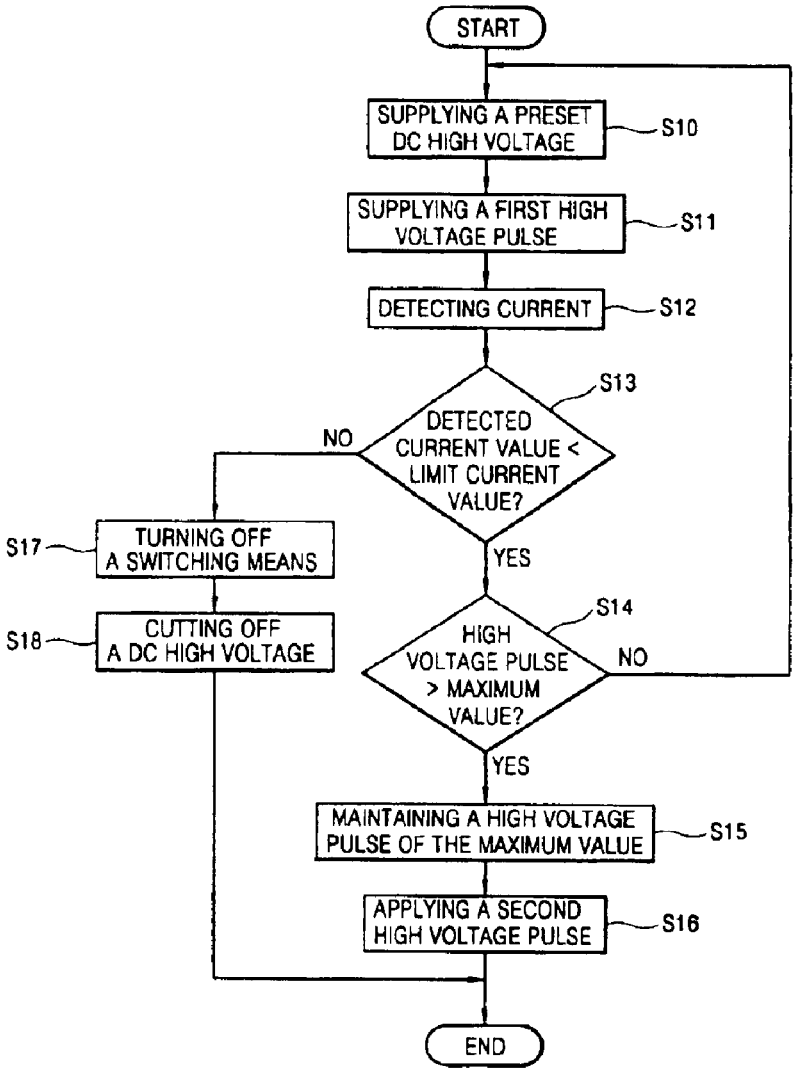
FIG. 5 is a flow chart illustrating an aging method of a FED in accordance with a first embodiment of the present invention.

FIG. 5 is a flow chart illustrating the aging method of the FED in accordance with the first embodiment of the present invention.

As depicted in FIG. 5, the aging method of the FED includes converting a direct current high voltage gradually increased to a preset maximum voltage into a high voltage pulse having uniform frequency and duty cycle and applying it to the anode electrode 5; detecting a current flowing when the high voltage pulse is applied to the anode electrode 5, comparing the detected current value with the preset limit current value and cutting off the high voltage pulse applied to the anode electrode 5 when the detected current value is greater than the limit current value; maintaining a high voltage pulse corresponded to the maximum high voltage till the preset pre-aging time when the maximum high voltage is applied to the anode electrode 5; and applying a certain voltage to the scan driving unit 20 for the main aging time after passing the pre-aging time, converting a direct current high voltage having a certain value into a high voltage pulse having a varied frequency and duty cycle according to time and applying it to the anode electrode 5. Hereinafter, the aging method of the FED will be described in detail.

First, a direct current high voltage having preset time, slant and limit current value is applied to the switching means as shown at step S10.

Afterward, by turning on/off the switching means according to a switching control signal having uniform frequency and duty cycle applied from the outside, the direct current high voltage is converted into a first high voltage pulse, namely, a high voltage pulse having a pulse form shown in FIG. 4, and the first high voltage pulse is applied to the anode electrode 5 as shown at step S11.

Current flowing in applying of the high voltage pulse to the anode electrode 5 is detected as shown at step S12, the detected current value is compared with a preset limit current value as shown at step S13, and it is judged whether the detected current damages the FED. In more detail, when the detected current value is not less than the preset limit current value, the switching means in which the direct current high voltage is applied is off as shown at step S17, and the high voltage pulse applied to the anode electrode 5 is cut off by cutting off the direct current high voltage as shown at step S18. In order to cut off the direct current high voltage or the first high voltage pulse, a method for stopping the program in the program controller 40B can be used also. Because all operations are performed according to the program, that method can be used.

On the other hand, when the detected current value is not greater than the preset limit current value, it is judged whether the first high voltage pulse applied to the anode electrode 5 is a preset maximum value as shown at step S14. When the first high voltage pulse applied to the anode electrode 5 is not greater than the maximum value, the preset direct current high voltage is applied again to the switching means as shown at step S14. Herein, time, slant and limit current values about the preset direct current high voltage are preset about each high voltage, and the set values are stored in the storing unit as a table form.

The operation is repeated until the applied direct current high voltage is not less than the preset maximum value (form the step S10 to the step S13), when the high voltage pulse applied to the anode electrode 5 is not less than the maximum value, the high voltage pulse having the maximum value is maintained for the preset pre-aging time (0~t2) as shown at step S15

Afterward, when the pre-aging time (0~t2) has passed, by turning on/off the switching means according to a pulse signal having a frequency and a duty cycle varied according to time, a second high voltage pulse having a frequency and a duty cycle increased according to time is applied to the anode electrode 5 as shown at step S16, simultaneously the power controller 40A applies a certain is voltage to the scan deriving unit 20 by the power control signal outputted from the program controller 40B, and accordingly the current aging operation is performed.

Contamination generated in the pre-aging and the main aging is discharged by the vacuum pump.

Accordingly, by applying the high voltage pulse according to the first embodiment of the present invention to the anode electrode, it is possible to perform aging for a time less than a time required for the conventional aging by the direct current high voltage. For example, when 10 hours is required for the conventional aging method, only several minutes is requited for the aging method of the present invention.

Hereinafter, a second embodiment of an aging apparatus of a FED and a method thereof capable of eliminating arching through aging for a short time and reducing energy consumption by converting the first high voltage pulse and the second high voltage pulse into a high voltage pulse of low energy and applying the high voltage pulse of low energy to the anode electrode of the panel will be described in detail with reference to FIGS. 6~11.

Second Embodiment

Figure 6:
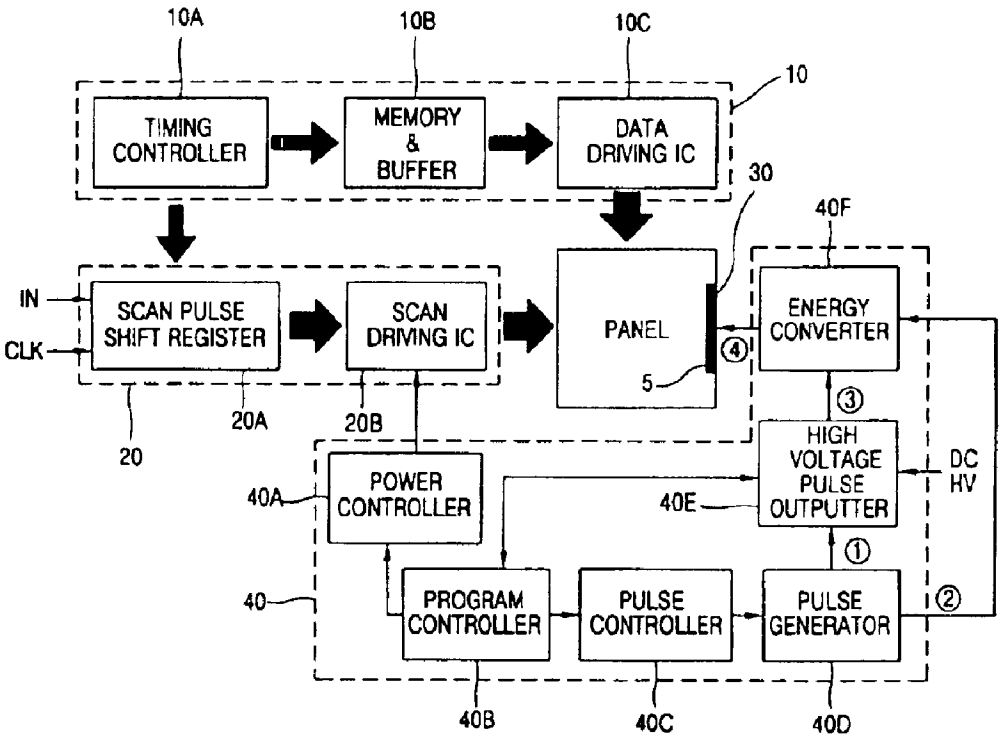
FIG. 6 is a block diagram illustrating a construction of an aging apparatus of a FED in accordance with a second embodiment of the present invention.

FIG. 6 is a block diagram illustrating a construction of an aging apparatus of a FED in accordance with a second embodiment of the present invention.

As depicted in FIG. 6, the aging apparatus of the FED in accordance with the second embodiment of the present invention includes a data driving unit 10 for outputting a timing control signal and a data pulse; a scan driving unit 20 for receiving data (IN) and a clock signal (CLK) from the outside by the timing control signal outputted from the data driving unit 10 and outputting a scan pulse; a panel 30 for displaying the data (IN) by receiving the data pulse from the data driving unit 10 and the scan pulse from the scan driving unit 20; and an aging controlling unit 40 for converting a direct current high voltage (DC HV) from the outside into a high voltage pulse, converting it into a high voltage pulse of low energy, applying it to an anode electrode 5 of the panel 30 and controlling an output voltage of the scan driving unit 20.

The data driving unit consists of a timing controller 10A; a memory and buffer 10B; and a data driving IC 10C. The scan driving unit 20 consists of a scan pulse shift register 20A; and a scan driving IC 20B.

In addition, the aging controlling unit 40 includes a power controller 40A for applying a predetermined voltage to the scan driving unit 20 according to a power control signal from the outside; a pulse controller 40C for outputting plural pulse control signals having a pulse width gradually increased according to time or uniform frequency and duty cycle regardless of time; a pulse generator 40D for receiving the plural pulse control signals from the pulse controller 40C and outputting plural switching control signals (①, ②) corresponded thereto; a high voltage pulse outputter 40E having a switching means (SW1) (not shown), turning on/off the switching means according to the switching control signal (①) from the pulse generator 40D in order to convert the direct current high voltage (DC HV) applied from the outside into a high voltage pulse (③) and output it; an energy converter 40F having a storing means (C) and a switching means (SW2) (not shown), storing the high voltage pulse outputted from the high voltage pulse outputter 40E in the storing means, turning on/off the switching means (SW2) according to the switching control signal (②) outputted from the pulse generator 40D, converting the high voltage pulse stored in the storing means into a high voltage pulse of low energy and applying the high voltage pulse of low energy into an anode electrode 5 of the panel 30; and a program controller 40B for detecting current outputted from the high voltage pulse outputter 40E, comparing the detected current value with a preset limit current value and outputting a power control signal to the power controller 40A. Hereinafter, the construction of the pulse controller will be described with reference to FIG. 7.

Figure 7:
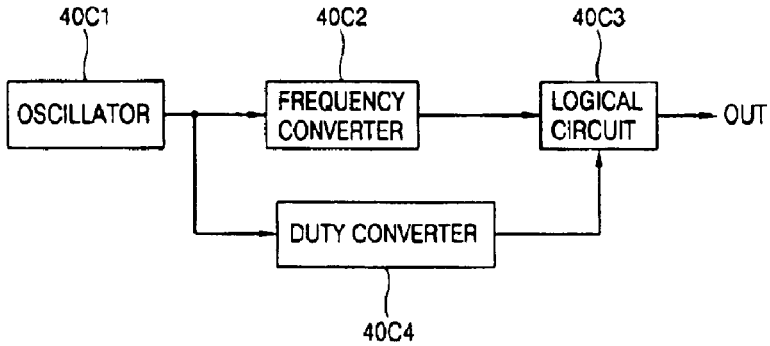
FIG. 7 is a block diagram illustrating a construction of a pulse controller in FIG. 6.

FIG. 7 is a block diagram illustrating a construction of a pulse controller in FIG. 6.

As depicted in FIG. 7, the pulse controller 40C includes an oscillator 40C1 for outputting a pulse signal having a certain frequency; a frequency converter 40C2 for converting a frequency of the pulse signal outputted from the oscillator 40C1 and outputting it; a duty converter 40C4 for receiving the pulse signal having a certain frequency outputted from the oscillator 40C1, converting and outputting a duty cycle of the pulse signal; and a logical circuit 40C3 for receiving the pulse signal outputted from the frequency converter 40C2 and the pulse signal outputted from the duty converter 40C4 and outputting two pulse control signals (out) different from each other to the pulse generator 40D.

Figure 8:
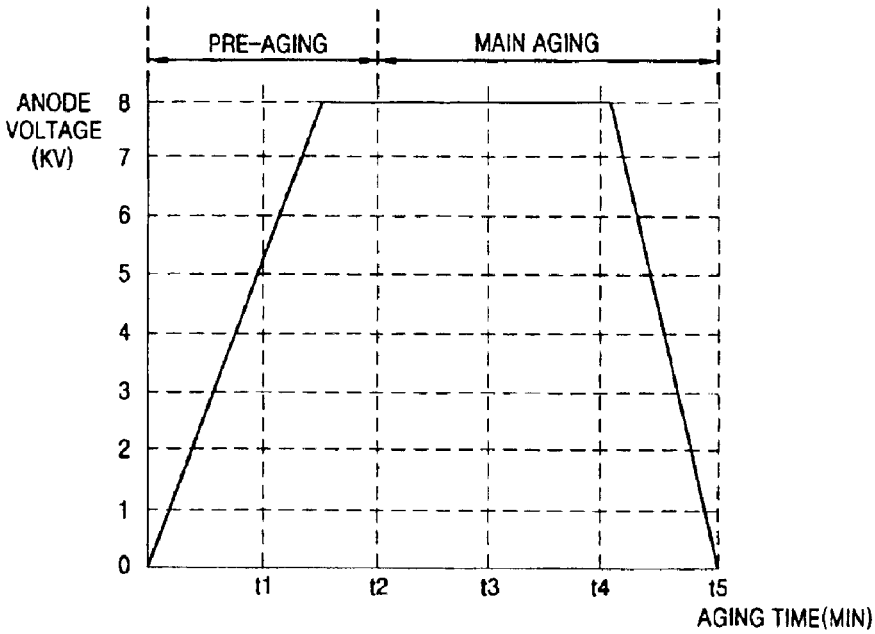
FIG. 8 illustrates a direct current high voltage applied in accordance with the second embodiment of the present invention.

The program controller 40B controls the direct current high voltage and applies it to the high voltage pulse outputter 40E. In more detail, as depicted in FIG. 8, the program controller 40B applies slant of the direct current high voltage and a maximum direct current high voltage controlled according to time to the high voltage pulse outputter 40E. Herein, the slant and direct current high voltage data according to time are stored in the program controller 40B or the memory as a table form, it is possible to control the applied direct current high voltage with the stored data, that technique has been described already, and accordingly detailed description will be abridged.

In addition, the program controller 40B is mutually connected with the high voltage pulse outputter 40E through a general interface bus, it detects current outputted from the high voltage pulse outputter 40E, when the detected current value is greater than a preset limit current value, in more detail, when excessive voltage or current is supplied to the anode electrode 5 or arching occurs by a certain influences, a direct current high voltage applied to the high voltage pulse outputter 40E is turned off or the program is stopped, and accordingly aging is stopped.

The power controller 40A is used in main aging as current aging through a scan driving voltage, and the power controller 40A is connected to the program controller 40B through a general interface bus.

In the operation of the aging apparatus of the FED in accordance with the present invention, a pre-aging operation and a main aging operation will be described reference to FIGS. 8~20.

FIG. 8 illustrates a direct current high voltage applied in accordance with the second embodiment of the present invention.

First, as depicted in FIG. 8, the program controller 40B controls the gradually increased direct current high voltage (DC HV) and applies it to the pulse controller 40C. Herein, the pulse controller 40C outputs two pulse control signals having uniform frequency and duty cycle. In more detail, when the oscillator 40C1 outputs a pulse signal having a certain frequency, the frequency converter 40C2 receives the pulse signal from the oscillator 40C1, converts the frequency of the pulse signal and outputs it.

In addition, the duty converter 40C4 receives the pulse signal from the oscillator 40C1, converts the duty cycle of the pulse signal and outputs it. The logical circuit 40C3 receives the pulse signal outputted form the frequency converter 40C2 and the pulse signal outputted from the duty converter 40C4 and outputs two different pulse control signals.

Figure 9:
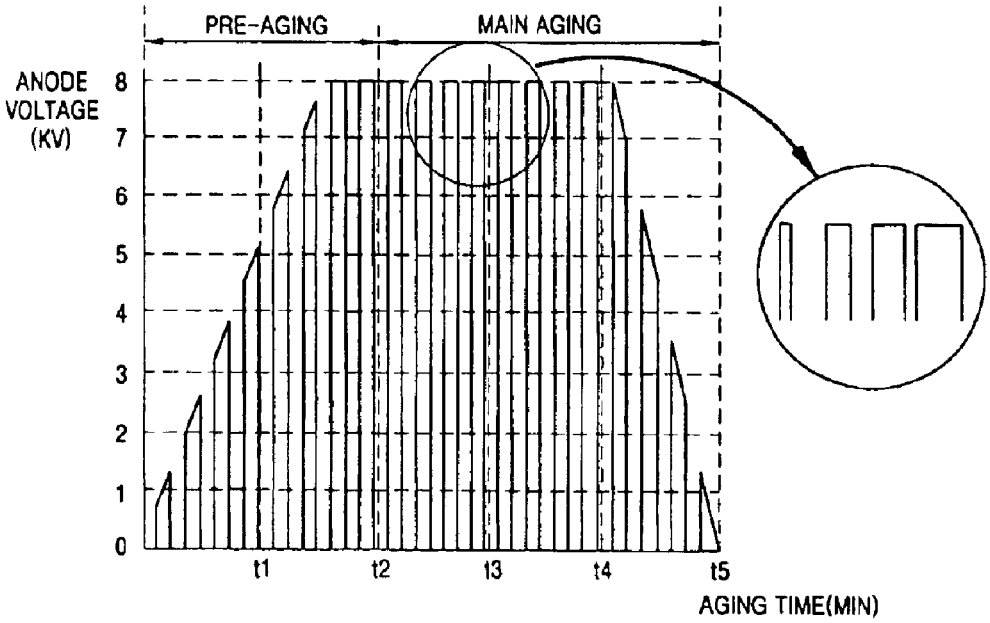
FIG. 9 illustrates a high voltage pulse applied to an anode electrode of a panel in accordance with a second embodiment of the present invention.

The pulse generator 40D receives the two difference pulse control signals from the logical circuit 40C3 and outputs two switching control signals (①, ②). As depicted in FIG. 8, the switching means (SW1) of the high voltage pulse outputter 40E receives the direct current high voltage gradually increased according to time, it is on/off according to the switching control signal outputted from the pulse generator 40D, and accordingly a high voltage pulse (③) having uniform frequency and duty cycle is outputted as depicted in FIG. 9.

The energy converter 40F stores the high voltage pulse energy from the high voltage pulse outputter 40E in a storing means (for example, condenser), turns on/off the switching means SW2 according to the switching control signal (②) outputted from the pulse generator 40D and converts the stored energy into a high voltage pulse of low energy (④). And, the converted high voltage pulse of low energy is applied to the anode electrode 5.

The pre-aging operation is performed for a pre-aging time, for the pre-aging time, a high voltage pulse applied to the anode electrode 5 is a high voltage pulse of low energy having uniform frequency and duty cycle regardless of time. And, that operation is performed in a not sealed state, contamination generated in the pre-aging operation is discharged by the vacuum pump.

When the pre-aging operation is finished, current aging, namely, main aging operation is performed. Hereinafter, the main aging operation will be described.

First, the pulse controller 40C outputs two different pulse control signals having a frequency and a duty cycle varied according to time. Herein, the pulse generator 40D outputs two switching control signals (①, ②) corresponded to the two pulse control signals to the high voltage pulse outputter 40E.

As depicted in FIG. 8, by being turned on/off according to the switching control signal (①), the switching means (SW1) of the high voltage pulse outputter 40E converts a maximum direct current high voltage or a gradually reduced direct current high voltage shown in FIG. 8 into a high voltage pulse having a duty cycle (pulse width) gradually increased according to time or a high voltage pulse having a varied duty cycle and frequency shown in FIG. 9 being turned on/off according to the switching control signal (①) and outputs it.

Afterward, the storing means of the energy converter 40F receives the high voltage pulse (③) from the high voltage pulse outputter 40E and stores energy thereof, and the switching means (SW2) is turned on/off according to the switching control signal (②) outputted from the pulse generator 40D and applies the high voltage pulse (④) of low energy discahrged in the storing means to the anode electrode 5. Herein, when the high voltage pulse of low energy is applied to the anode electrode 5, a power control signal is outputted from the program controller 40B to the power controller 40A, and the power controller 40A receives the power control signal, controls the scan driving unit 20 and applies a certain power (for example, −5V) to the panel 30. In more detail, the current aging is performed by emitting electrons from the scan electrode 2 of the FED.

Herein, in performing of the main aging, because the duty cycle of the high voltage pulse applied to the anode electrode 5 is gradually increased according to time passage, aging is tried with a lower current in the early stage, aging is tried with higher current according to time passage, and accordingly it is possible to reduce a total aging time and prevent arching. In more detail, by performing aging according to time passage under a condition in which the actual panel 30 is operated, it is possible to reduce arching occurrence in operating of the panel 30. In more detail, as depicted in FIG. 9, by applying a high voltage pulse in which a pulse width is gradually increased according to time, the main aging is performed.

Contamination taken away through the main aging is discharged to the outside by the vacuum pump, when the pre-aging and the main aging operations are finished, a vacuum region in the high vacuum state is sealed.

Hereinafter, the operation for applying the high voltage pulse of low energy to the anode electrode 5 for the pre-aging and main aging time will be described in detail with reference to FIG. 10.

Figure 10:
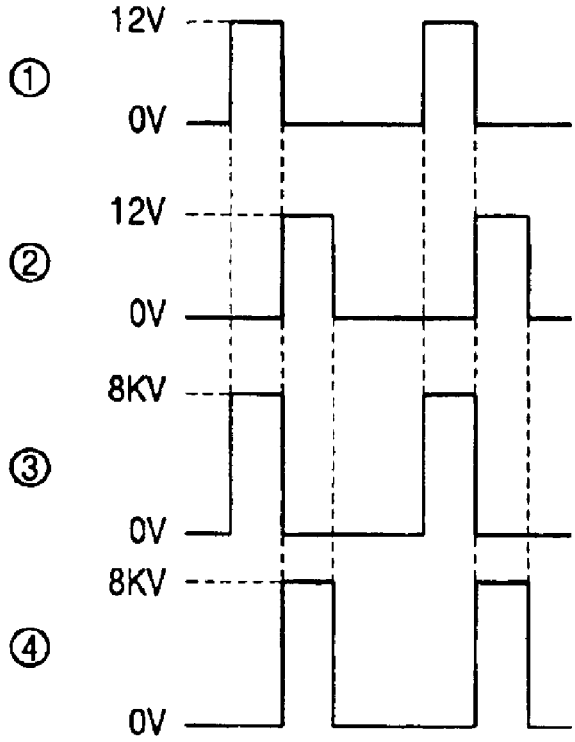
FIG. 10 illustrates a wave form of an output signal of each unit shown in FIG. 3.

FIG. 10 illustrates timing of the two switching control signals (①, ②) outputted from the pulse generator 40D, the high voltage pulse (③) outputted from the high voltage pulse outputter 40E and the high voltage pulse of low energy (④) outputted from the energy converter 40F to the anode electrode 5.

As depicted in FIG. 10, the direct current high votlage (for example, 8KV) applied for a time in which the switching control signal (①) applied to the high voltage pulse outputter 40E is turned on is converted into the high voltage pulse (③), and energy of the high voltage pulse is stored in the storing means (for example, condenser) of the energy converter 40F for a time in which the high voltage pulse is outputted.

The energy of the high voltage pulse stored in the storing means is converted into the high voltage pulse of low energy for a time in which the output of the high voltage pulse outputter 40E is off and the switching control signal (①) applied to the energy converter 40F is on, and the high voltage pulse of low energy is applied to the anode electrode 5. Herein, because not all energy stored in the storing means but a discharged quantity of energy is applied to the anode electrode 5, energy very lower than the input is applied to the anode electrode 5. In more detail, the switching means (SW1, SW2) of the high voltage pulse outputter 40E and the energy converter 40F are on/off by the switching control signals (①, ②) shown in FIG. 10, and accordingly the high voltage pulse of low energy is applied to the anode electrode 5.

Figure 11:
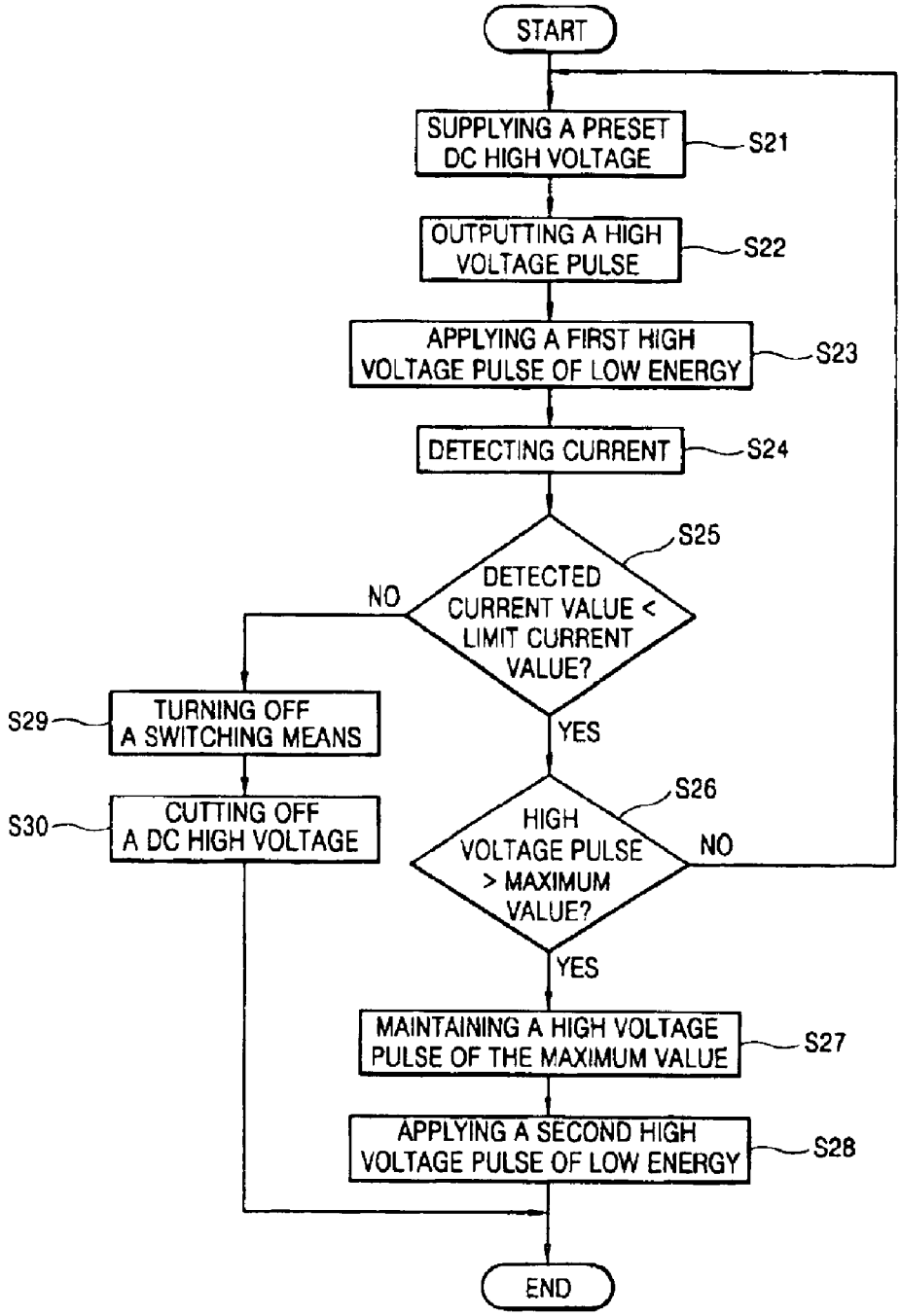
FIG. 11 is a flow chart illustrating an aging method of a FED in accordance with a second embodiment of the present invention.

FIG. 11 is a flow chart illustrating an aging method of a FED in accordance with a second embodiment of the present invention.

As depicted in FIG. 11, the aging method of the FED in accordance with the second embodiment of the present invention includes applying a preset direct current high voltage; converting the applied direct current high voltage into a high voltage pulse by a pulse signal having a preset frequency and duty cycle; converting the high voltage pulse into a high voltage pulse of low energy and applying the converted first high voltage pulse of low energy to an anode electrode of a panel for a pre-aging time; converting the direct current high voltage into a high voltage pulse by a pulse signal having a duty cycle (pulse width) gradually increased according to time after the pre-aging time; and converting the high voltage pulse having a pulse width increased according to the time into a high voltage pulse of low energy, applying the second high voltage pulse of low energy to the anode electrode of the panel for a main aging time and simultaneously applying a predetermined voltage to a scan driving unit.

In addition, the aging method of the FED in accordance with of the present invention further includes detecting current and voltage of the high voltage pulse applied to the anode electrode and comparing the detected current value with a preset limit current value; and turning off the high voltage applied to the anode electrode 5 when the detected current value is greater than the preset limit current value in the comparison result. A pre-aging and a main aging operations of the present invention will be described.

First, the pre-aging operation will be described. When a preset direct current high voltage is applied to the switching means (SW1) of the high voltage pulse outputter 40E as shown at step S21, the switching means (SW1) is turned on/off by the switching control signal having uniform frequency and duty cycle, and accordingly a high voltage pulse having uniform frequency and duty cycle is outputted as shown at step S22. Herein, the preset direct current high voltage has a form shown in FIG. 8, for the pre-aging and main aging time, data about high voltage pulse and slant according to apply time of a gradually increased direct current high voltage and a gradually reduced direct current high voltage are stored in the memory of the aging apparatus as a table form. In addition, in apply of the direct current high voltage, a direct current high voltage having the same form in FIG. 8 is applied by using the data stored in the memory. In more detail, by the program, the direct current high voltage is applied.

The energy of the outputted high voltage pulse is stored in the storing means of the energy converter 40F, by turning on/off the switching means (SW2) according to the switching control signal having uniform frequency and duty cycle received from the outside, part of the energy stored in the storing means is outputted as a high voltage pulse. In more detail, the high voltage pulse converted into low energy is applied to the anode electrode 5 of the panel as shown at step S23. Herein, the low energy-converted high voltage pulse or current of the high voltage pulse outputted from the high voltage pulse outputter 40E is detected as shown at step S35, and it is judged whether the detected current damages the FED by comparing the detected current value with a preset limit current value as shown at step S24. In more detail, when the detected current value is greater than the present limit current value, by turning off the switching means in which the direct current high voltage is applied, the applied direct current high voltage is cut off or the program itself is shut down, and accordingly the high voltage pulse applied to the anode electrode 5 is cut off as shown at steps S25, S29 and S30.

On the contrary, when the detected current value is less than the present limit current value, by using the data stored in the memory up to appliable maximum high voltage, a high voltage pulse having a certain slant is applied. Of course, whenever the high voltage pulse is applied, current applied to the anode electrode 5 is detected and compared.

When a maximum high voltage pulse of the inputted direct current high voltage is applied as shown at step S26, for the present time, for example, as depicted in FIG. 9, the maximum high voltage pulse is maintained until the time (t2), and the pre-aging is performed as shown at step S27.

Afterward, when the pre-aging operation is finished, the main aging operation is performed. Herein, the switching control signal applied to the high voltage pulse outputter 40E and the energy converter 40F is a switching control signal having a pulse duty cycle, namely, a pulse width gradually increased according to time.

By receiving the switching control signal in which a pulse width is gradually increased according to time, the high voltage pulse outputter 40E receives a maximum direct current high voltage applied from the outside or a gradually-reduced direct current high voltage and outputs a high voltage pulse shown in FIG. 9.

The energy converter 40F converts the high voltage pulse having a pulse width increased according to time into a second high voltage pulse and applies the second high voltage pulse of low energy to the anode electrode 5 of the panel 30 as shown at step S28. Herein, when the second high voltage pulse of low energy is applied to the anode electrode 5, the predetermined voltage is applied to the scan electrode 2 of the panel 30 through the scan driving unit 20. In more detail, by applying a certain voltage to the scan electrode 2, electrons are emitted, b using the emitted electrons, current aging is performed. Contamination emitted in the pre-aging and the main aging is discharged by the vacuum pump.

Accordingly, in the embodiment of the present invention, by applying the high voltage pulse of low energy to the anode electrode, it is possible to reduce an aging time in comparison with the conventional aging by a direct current high voltage. For example, when aging time is required for 10 hours in the conventional method, in the present invention, only aging time for several minutes is required.

As described-above, in the present invention, by applying a first high voltage pulse having uniform frequency and duty cycle to an anode of the panel or applying a second high voltage pulse having a frequency and a duty cycle varied according to time to the anode electrode of the panel, damage occurrable by the direct current high voltage can be reduced, and accordingly it is possible to increase life span of the FED and improve product's quality.

In addition, in the present invention, by applying the high voltage pulse to the anode electrode of the panel, it is possible to reduce energy consumption and a time required for aging.

In addition, in the present invention, by converting a first high voltage pulse having uniform frequency and a duty cycle and a second high voltage pulse having a frequency and a duty cycle varied according to time passage into a high voltage pulse of low energy and applying the converted high voltage pulse of low energy to the anode electrode, arching can be reduced through aging for a short time, and energy consumption may be reduced.

What is claimed is:

1. A method for eliminating contamination of a FED (field emission display) by applying a direct current high voltage to an anode electrode of the FED, comprising:

converting a direct current high voltage into a first high voltage pulse having uniform frequency and duty cycle or a second high voltage pulse having a frequency and a duty cycle varied according to time; and applying the converted first high voltage pulse or second high voltage pulse to an anode electrode of the FED, wherein a predetermined voltage is applied to a scan driving unit of the FED when the second high voltage pulse is applied to the anode electrode.

2. A method for eliminating contamination of a FED (field emission display) by applying a direct current high voltage to an anode electrode of the FED, comprising:

converting a direct current high voltage into a first high voltage pulse having uniform frequency and duty cycle or a second high voltage pulse having a frequency and a duty cycle varied according to time; and applying the converted first high voltage pulse or second high voltage pulse to an anode electrode of the FED, wherein the first high voltage pulse is outputted to the anode electrode of the panel for a preset pre-aging time.

3. A method for eliminating contamination of a FED (field emission display) by applying a direct current high voltage to an anode electrode of the FED, comprising:

converting a direct current high voltage into a first high voltage pulse having uniform frequency and duty cycle or a second high voltage pulse having a frequency and a duty cycle varied according to time; and applying the converted first high voltage pulse or second high voltage pulse to an anode electrode of the FED, wherein the second high voltage pulse is outputted to the anode electrode of the panel for a preset main aging time.

4. A method for eliminating contamination of a FED (field emission display) by applying a direct current high voltage to an anode electrode of the FED, comprising:

converting a direct current high voltage into a first high voltage pulse having uniform frequency and duty cycle or a second high voltage pulse having a frequency and a duty cycle varied according to time; and applying the converted first high voltage pulse or second high voltage pulse to an anode electrode of the FED, wherein width of the second high voltage pulse is gradually increased with the passage of time.

5. The method of claim 1, 2, 3 or 4, further comprising:

converting the first or second high voltage pulse into a high voltage pulse of low energy; and applying the low energy high voltage pulse to the anode electrode of the panel.

6. An apparatus for eliminating contamination of a FED (field emission display) by applying a direct current high voltage to an anode electrode of the FED, comprising:

an aging controlling unit for converting a direct current high voltage into a first high voltage pulse having uniform frequency and duty cycle or a second high voltage pulse having a frequency and a duty cycle varied according to time and applying the converted first high voltage pulse or second high voltage pulse to an anode electrode of a panel, wherein the aging controlling unit applies a predetermined voltage to a scan driving unit of the FED in applying of the second voltage pulse to the anode electrode.

7. An apparatus for eliminating contamination of a FED (field emission display) by applying a direct current high voltage to an anode electrode of the FED, comprising:

an aging controlling unit for converting a direct current high voltage into a first high voltage pulse having uniform frequency and duty cycle or a second high voltage pulse having a frequency and a duty cycle varied according to time and applying the converted first high voltage pulse or second high voltage pulse to an anode electrode of a panel, wherein the aging controlling unit converts the direct current high voltage into a high voltage pulse having uniform frequency and duty cycle for a preset pre-aging time, converts the direct current high voltage into a high voltage pulse having frequency and duty cycle varied with the passage of time for a preset main aging time and applies a predetermined voltage to the scan driving unit for the main aging time.

8. The apparatus of claim 7, wherein the aging controlling unit includes:

a power controller for applying a predetermined voltage to a scan driving unit according to a power control signal;

a pulse controller for outputting a pulse control signal corresponded to uniform frequency and duty cycle or frequency and duty cycle variable with the passage of time on the basis of a program control signal;

a pulse generator for outputting a pulse signal corresponded to the pulse control signal outputted from the pulse controller;

a high voltage pulse outputter for converting a direct current high voltage into a high voltage pulse on the basis of the pulse signal from the pulse generator and applying it to the anode electrode; and a program controller for detecting an electric current applied from the high voltage pulse outputter to the anode electrode, outputting a program control signal to the pulse controller on the basis of the detected current value and a preset limit current value and outputting a power control signal to the power controller.

9. The apparatus of claim 8, wherein the pulse controller includes:

an oscillator for receiving the program control signal from the program controller and outputting a frequency;

a frequency converter for converting the frequency outputted from the oscillator into a predetermined frequency;

a duty converter for outputting a duty cycle corresponded to the program control signal outputted from the program controller; and a logical circuit for outputting a pulse control signal to the pulse generator on the basis of the frequency converted in the frequency converter and the duty cycle outputted from the duty converter.

10. An apparatus for eliminating contamination of a FED (field emission display) by applying a direct current high voltage to an anode electrode of the FED, comprising:

an aging controlling unit for converting a direct current high voltage into a first high voltage pulse having uniform frequency and duty cycle or a second high voltage pulse having a frequency and a duty cycle varied according to time and applying the converted first high voltage pulse or second high voltage pulse to an anode electrode of a panel, wherein the aging controlling unit further includes a means for converting the first and second high voltage pulse into a high voltage pulse of low energy, herein, width of the second high voltage pulse is gradually increased with the passage of time.

11. The apparatus of claim 10, wherein the aging controlling unit includes:

a power controller for applying a predetermined voltage to the scan driving unit of the FED according to a power control signal;

a pulse controller for outputting plural pulse control signals having uniform or variable frequency and duty cycle with the passage of time;

a pulse generator for outputting plural switching control signals corresponded to the plural pulse control signals from the pulse controller;

a high voltage pulse outputter having a first switching means and converting a direct current high voltage applied from the outside into a high voltage pulse by being turned on/off according to the switching control signal outputted from the pulse generator;

an energy converter having a second switching means, storing the high voltage pulse from the high voltage pulse outputter in the storing means, converting the high voltage pulse stored in the storing means into a high voltage pulse of low energy by being turned on/off according to the switching control signal from the pulse generator and applying the converted high voltage pulse of low energy to the anode electrode; and a program controller for detecting a current outputted from the high voltage pulse outputter and outputting a power control signal to the power controller on the basis of the detected current value and a present limit current value.

12. The apparatus of claim 11, wherein the pulse controller includes:

an oscillator for outputting a pulse signal having a certain frequency;

a frequency converter for converting a frequency of a pulse signal outputted from the oscillator;

a duty converter for converting a duty cycle of a pulse signal outputted from the oscillator; and a logical circuit for outputting plural pulse control signals to the pulse generator on the basis of the frequency converted by the frequency converter and the duty cycle converted by the duty converter.

13. In an aging method for eliminating contamination of a FED (field emission display) by applying a direct current high voltage to an anode electrode of the FED, an aging method of a FED, comprising:

converting a direct current high voltage into a first high voltage pulse having uniform frequency and duty cycle and applying the converted first high voltage pulse to an anode electrode of a panel for a preset pre-aging time; and converting a direct current high voltage into a second high voltage pulse having variable frequency and duty cycle and applying the converted second high voltage pulse to the anode electrode of the panel for a preset main aging time;

wherein a predetermined voltage is applied to a scan driving unit of the FED when the second high voltage pulse is applied to the anode electrode.

14. The method of claim 13, wherein width of the second high voltage pulse is gradually increased with the passage of time.

15. The method of claim 13, further comprising:

converting the first and second high voltage pulse into a high voltage pulse of low energy; and applying the low energy high voltage pulse to the anode electrode of the panel.

16. An aging apparatus of a FED (field emission display), comprising:

a means for converting a direct current high voltage into a first high voltage pulse having uniform frequency and duty cycle and applying the converted first high voltage pulse to an anode electrode of a panel for a preset pre-aging time;

a means for converting the direct high voltage into a second high voltage pulse having variable frequency and duty cycle and applying the converted second high voltage pulse to the anode electrode of the panel for a preset main aging time; and a means for applying a predetermined voltage to a scan driving unit of the FED in applying of the second high voltage pulse to the anode electrode.

17. The apparatus of claim 16, further comprising:

a means for converting the first and second high voltage pulse into a high voltage pulse of low energy and applying the low energy high voltage pulse to the anode electrode of the panel.

18. The apparatus of claim 16, wherein a width of the second high voltage pulse is gradually increased with the passage of time.

* * * * *